United States Patent [19]

Howell et al.

[11] Patent Number: 4,708,784

[45] Date of Patent: Nov. 24, 1987

[54] HYDROVISBREAKING OF OILS

[75] Inventors: Jerald A. Howell; Simon G. Kukes, both of Bartlesville, Okla.

[73] Assignee: Phillips Petroleum Company, Bartlesville, Okla.

[21] Appl. No.: 18,690

[22] Filed: Feb. 25, 1987

Related U.S. Application Data

[63] Continuation-in-part of Ser. No. 917,746, Oct. 10, 1986, abandoned.

[51] Int. Cl.[4] ..... C10G 45/04

[52] U.S. Cl. ..... 208/112; 208/108; 208/216 R; 208/243; 208/251 H; 208/254 H; 502/150

[58] Field of Search ..... 208/112, 108, 216 R, 208/251 H, 254 H, 243, 107; 502/150, 152, 170

[56] References Cited

U.S. PATENT DOCUMENTS

| | | | |
|---|---|---|---|
| 1,876,270 | 9/1932 | Zorn | 44/68 |
| 2,805,997 | 9/1957 | Benoit et al. | 252/42.7 |
| 2,987,478 | 6/1961 | Matson | 252/46.4 |
| 3,117,074 | 1/1964 | Honerkamp | 208/108 |
| 3,161,585 | 12/1964 | Gleim et al. | 208/264 |
| 3,196,104 | 7/1965 | Gleim et al. | 208/264 |
| 3,285,942 | 11/1966 | Price et al. | 260/429 |
| 3,331,769 | 7/1967 | Gatsis | 208/210 |
| 3,816,301 | 6/1974 | Sorgenti | 208/243 |
| 3,897,470 | 7/1975 | Sias | 260/429 K |
| 3,931,265 | 1/1976 | Sias | 260/440 |
| 4,009,122 | 2/1977 | Lines et al. | 252/431 N |
| 4,046,783 | 9/1977 | Cavitt | 260/348.33 |
| 4,066,530 | 1/1978 | Aldridge et al. | 208/112 |
| 4,243,553 | 1/1981 | Naumann et al. | 252/439 |
| 4,285,804 | 8/1981 | Jacquin et al. | 208/48 R |
| 4,348,270 | 9/1982 | Bearden, Jr. et al. | 208/9 |
| 4,357,229 | 11/1982 | Bearden, Jr., et al. | 208/10 |
| 4,389,301 | 6/1983 | Dahlberg et al. | 208/59 |
| 4,399,024 | 2/1981 | Fukui et al. | 208/131 |
| 4,428,848 | 1/1984 | Levine et al. | 252/32.7 |
| 4,431,520 | 2/1984 | Giuliani et al. | 208/112 |
| 4,435,277 | 3/1984 | Dinh | 208/108 |
| 4,457,835 | 7/1984 | Kukes | 208/251 H |
| 4,478,729 | 10/1984 | Hunt et al. | 252/33.2 |
| 4,513,098 | 4/1985 | Tsao | 502/216 |
| 4,581,127 | 4/1986 | Voirghese | 208/143 |
| 4,608,152 | 8/1986 | Howell et al. | 208/108 |
| 4,610,776 | 9/1986 | Urban et al. | 208/418 |
| 4,612,110 | 9/1986 | Kukes et al. | 208/251 H |

OTHER PUBLICATIONS

"Novel Catalyst and Process for Upgrading Residual and Heavy Crudes", by R. Bearden and C. L. Aldridge, AICHE 9th National Meeting, Apr. 5-9, 1981.

*Primary Examiner*—Andrew Metz
*Assistant Examiner*—Anthony McFarlane
*Attorney, Agent, or Firm*—K. K. Brandes

[57] ABSTRACT

A hydrotreating (hydrovisbreaking) process comprises the step of contacting under suitable reaction conditions (A) a substantially liquid hydrocarbon-containing feed stream which contains more than 0.1 weight-% Ramsbottom carbon residue, (B) a free hydrogen-containing gas and (C) a catalyst composition comprising alkyl molybdate and/or molybdenum sulfonate.

34 Claims, No Drawings

HYDROVISBREAKING OF OILS

This is a continuation-in-part application of our copending application Ser. No. 917,746, filed Oct. 10, 1986, now abandoned.

BACKGROUND OF THE INVENTION

In one aspect, this invention relates to a process for hydrovisbreaking liquid hydrocarbon-containing feed streams so as to produce lower boiling hydrocarbons. In another aspect, this invention relates to the use of organic molybdenum compounds as catalysts in a hydrovisbreaking process so as to minimize coke formation.

It is well known to hydrotreat (hydrofine) liquid hydrocarbon-containing feed streams such as heavy oils, which contain undesirable metal and sulfur compounds as impurities and also considerable amounts of cokable materials (referred to as Ramsbottom carbon residue), so as to convert them to lower boiling materials having lower molecular weight than the feed hydrocarbons and to remove at least a portion of metal and sulfur impurities and cokable materials. A specific type of hydrotreating process is heat-soaking, preferably with agitation, in the presence of hydrogen but preferably in the absence of a fixed catalyst bed, hereinafter referred to as hydrovisbreaking.

One of the operational problems of such hydrovisbreaking processes is the formation of undesirably high amounts of coke, which represents losses in hydrocarbonaceous materials and also may necessitate a costly separation step. Therefore, there is an ever present need to develop new oil hydrotreating processes utilizing efficient hydrotreating agents designed to reduce coke formation.

SUMMARY OF THE INVENTION

It is an object of this invention to provide a process for hydrotreating substantially liquid hydrocarbon-containing feed streams under such conditions as to minimize coke formation. It is another object of this invention to employ in said process novel hydrotreating catalyst compositions, which contain molybdenum. It is a further object of this invention to provide a process for hydrovisbreaking heavy oils that contain Ramsbottom carbon residue. Other objects and advantages will be apparent from the detailed description and the appended claims.

In accordance with this invention, a hydrotreating process comprises the step of contacting (A) a substantially liquid hydrocarbon-containing feed stream, which also contains Ramsbottom carbon residue (determined by ASTM D524) in excess of about 0.1 weight-%, simultaneously with (B) a free hydrogen-containing gas, and (C) a catalyst composition comprising (preferably consisting essentially of) at least one compound (i.e., one compound or mixture of two or more compounds) selected from the group consisting of alkyl molybdates (preferred) and molybdenum sulfonates, under such hydrotreating conditions as to obtain a liquid product having reduced amounts of Ramsbottom carbon residue and reduced amounts of hydrocarbons boiling in excess of 1000° F. (at atmospheric pressure).

The preferred at least one alkyl molybdate is at least one substituted glycol molybdate complex, more preferably at least one ester-substituted glycol molybdate complex. Preferably, the contacting of the hydrocarbon-containing feed stream with the hydrogen-containing gas and the catalyst composition is carried out by heating wih agitation, in the substantial absence of a fixed bed of solid hydrofining catalyst. Also preferably, added carbon particles, added metal particles and added particles of metal compounds should be substantially absent during said contacting. The preferred hydrocarbon feed stream contains more than about 1 weight-% Ramsbottom carbon residue.

Use of catalyst composition (C) (preferably alkyl molybdate) in the hydrotreating (hydrovisbreaking) process of this invention results in less coke formation than hydrotreating with no additive. It is presently believed that catalyst composition (C) decomposes under the hydrotreating conditions to metallic Mo and/or oxides, sulfides and carbides of Mo.

DETAILED DESCRIPTION OF THE INVENTION

Any hydrocarbon-containing feed stream that is substantially liquid at the contacting conditions of the process of this invention and contains Ramsbottom carbon residue (determined according to ASTM D524) in excess of about 0.1 weight-% can be processed in accordance with the present invention. Non-limiting examples of suitable hydrocarbon-containing feed streams are heavy crude oils, crude oil residua, heavy fractions of liquid coal pyrolyzates, heavy fractions of liquid products obtained by extraction or by liquefaction of coal (including lignite), heavy fractions of liquid products obtained by extraction or by pyrolysis of tar sands, heavy shale oils, and heavy shale oil fractions. Preferred hydrocarbon feed streams include full-range (untopped) crudes, topped crudes (residua) having a boiling range (at atmospheric conditions) in excess of about 343° C., and other materials which are generally regarded as too heavy to be distilled. These materials will generally contain the highest concentrations of Ramsbottom carbon residue, metals (Ni, V), sulfur and nitrogen.

Preferably, the Ramsbottom carbon residue content of the hydrocarbon feed stream exceeds about 1 weight-% and more preferably is in the range of about 2 to about 30 weight-%. Preferably, the hydrocarbon-containing feed steam also contains about 3–500 ppmw (parts by weight per million parts by weight of feed) nickel, about 5–1000 ppmw vanadium, about 0.2–6 weight-% sulfur, about 0.1–3 weight-% nitrogen and 1–99 weight-% of materials boiling in excess of about 1000° F. under atmospheric pressure conditions. Preferably the $API_{60}$ gravity (measured at 60° F.) of the feed is in the range of from about 4 to about 30.

The free hydrogen containing gas used in the hydrotreating process of this invention can be substantially pure hydrogen gas, or can be mixtures of hydrogen with other gases such as nitrogen, helium, methane, ethane, carbon monoxide or hydrogen sulfide. At present, substantially pure hydrogen gas is preferred.

Any suitable alkyl molybdate can be used in catalyst composition (C). Non-limiting examples of suitable alkyl molybdates are those described in U.S. Pat. Nos. 4,046,783, 3,285,942, 2,987,478 and 2,805,997, herein incorporated by reference. Presently preferred are substituted glycol molybdate complexes disclosed in U.S. Pat. No. 3,285,942, with the additional stipulation that the alkyl groups $R_1$, $R_2$ and $R_3$ in the formulas in column 1 of U.S. Pat. No. 3,285,942 can be ester-substituted alkyl groups. The presently more preferred catalyst composition comprises an ester-substituted glycol molybdate complex prepared by reaction of $MoO_3$ and a glycerol monocarboxylate, wherein the carboxylate group can have 1–40 carbon atoms, more preferably 10–25 carbon atoms. The presently most preferred ester-substituted molybdate complex has been prepared by reaction of $MoO_3$ and glycerol monooleate, substantially in accordance with the preparation method disclosed in U.S. Pat. No. 3,285,942. The presently most preferred ester-substituted glycol molybdate complex contains about 4–6 weight-% Mo, about 70–73 weight-% C, about 11–13 weight-% H and about 1–1.5 weight-% N.

Any suitable molybdenum sulfonate can be used in catalyst composition (C). Non-limiting examples of suitable molybdenum sulfonates are those described in U.S. Pat. Nos. 4,478,729, 3,931,265 and 3,897,470, herein incorporated by reference. Presently preferred are molybdenum compounds of aromatic sulfonic acids (such as toluene sulfonic acid). The presently most preferred molybdenum sulfonate containing catalyst composition contains about 10–13 weight-% Mo, about 52–55 weight-% C, about 7–9 weight-% H, about 3–4 weight-% N and about 6–7 weight-% S.

Any suitable amount of catalyst composition (C) can be employed. The amount of the catalyst composition added to the hydrocarbon-containing feed will generally be such as to provide a concentration of about 1–2000 ppmw, more preferably about 5–500 ppmw, of molybdenum (calculated as element) in the feed stream.

Any suitable quantity of the free hydrogen containing gas can be employed in the process of this invention. The quantity of hydrogen gas used to contact the hydrocarbon-containing feedstock, either in a continuous or in a batch process, will generally be in the range of about 100 to about 20,000 standard cubic feet (SCF) $H_2$ per barrel of the hydrocarbon-containing feed and will more preferably by in the range of about 500 to about 5,000 standard cubic feet $H_2$ per barrel of the hydrocarbon-containing feed stream.

The hydrotreating process of this invention can be carried out by means of any suitable apparatus whereby there is achieved an intimate contact of the hydrocarbon-containing feed stream, the free hydrogen-containing gas and the substantially liquid Mo-S-containing catalyst composition (C), under such hydrotreating (hydrovisbreaking) conditions as to produce a liquid hydrocarbon-containing product having lower Ramsbottom carbon residue than the feed stream. Generally, this hydrovisbreaking process also reduces the amount of materials boiling in excess of 1000° F. (at 1 atm) and the amounts of nickel, vanadium, sulfur and nitrogen compounds contained as impurities in the hydrocarbon-containing feed stream. The hydrovisbreaking process can be carried out as a continuous process or as a batch process.

The hydrovisbreaking (hydrotreating) process of this invention is in no way limited to the use of any particular type of process or apparatus. The term "feed stream" refers to continuous and batch processes. In a continuous operation, it is preferred to premix the hydrocarbon feed stream with the liquid catalyst composition, e.g., in a vessel equipped with a mechanical stirrer, or in a static mixer, or by means of a recirculating pump. This mixture of (A) and (C) is then passed concurrently with a stream of free hydrogen-containing gas into the bottom portion of a reactor, which is preferably equipped with heating means and also mechanical agitating or static mixing means so as to provide intimate contact of the process ingredients (A), (B) and (C) at elevated temperatures. The products generally exit through outlets located in the top portion of the reactor. In a batch operation, (A) and (C) can also be premixed and charged to a reactor equipped with heating means and agitating a static mixing means. The reactor is then generally pressured with hydrogen gas. However, it is within the scope of this invention to introduce process ingredients (A), (B) and (C) simultaneously, or sequentially in any order, to the reactor.

It is within the scope of this invention to have solid materials present, such as unpromoted refractory oxides, sulfides, sulfates or phosphates (e.g., $Al_2O_3$, $SiO_2$, $AlPO_4$, $Fe_2O_3$, and the like) or promoted hydrofining catalysts (e.g., $Ni/Mo/Al_2O_3$ or $Co/Mo/Al_2O_3$). However, it is presently preferred to substantially exclude such solid materials during the hydrotesting process of this invention so as to avoid operational problems, such as plugging of product exit lines by entrained solids, and also to avoid the need for a liquid-solid separation of the product produced by the hydrovisbreaking process of this invention. In particular, added solid metal compounds (in particular iron oxide or iron sulfide), added metal particles (such as Fe, Al and the like) and added carbon particles (such as soot, charcoal, coke, graphite and the like; particularly soot particles of the cenosphere type) should be substantially absent during the hydrotreating process so as to avoid operational problems.

Any suitable reaction time in the hydrovisbreaking (hydrotreating) process of this invention can be utilized. In general, the reaction time, i.e., the time of contact between (A), (B) and (C), will range from about 0.01 hours to about 20 hours. Preferably, the reaction time will range from about 0.1 to about 5 hours, and more preferably from about 0.25 to about 3 hours. Thus, for a continuous process, the flow rate of the hydrocarbon containing feed stream should be such that the time required for the passage of the mixture through the reactor (residence time) will preferably be in the range of about 0.1to about 5 hours, and more preferably about 0.25 to about 3 hours. For a batch process, the hydrocarbon-containing feed stream will preferably remain in the reactor for a time in the range of about 0.1 hours to about 5 hours, and more preferably from about 0.25 hours to about 3 hours.

The hydrovisbreaking process of this invention can be carried out at any suitable temperature. The temperature will generally be in the range of about 250° C. to about 550° C. and will preferably be in the range of about 380° to about 480° C. Higher temperatures do improve the removal of impurities but such temperatures may have adverse effects on coke formation. Also, economic consideration will have to be taken into consideration in the selection of the reaction temperature.

Any suitable pressure can be uitlized in the hydrovisbreaking process of this invention. The reaction pressure will generally be in the range of about atmospheric (0 psig) to about 10,000 psig. Preferably, the pressure will be in the range of about 500 to about 3,000 psig. Higher pressures tend to reduce coke formation (because of a higher partial pressure of $H_2$) but operation at high pressure may have adverse economic consequences.

The gaseous, liquid and solid products of the hydrotreating (hydrovisbreaking) process of this invention can be withdrawn from the contacting reactor and separated from each other by any conventional separating means. Also, the fractionation of the liquid hydrocarbon product having reduced Ramsbottom carbon residue into fractions boiling in different temperature ranges can be carried out by any conventional distillation means, either under atmospheric or vacuum conditions.

Preferably, at least a portion of the liquid hydrocarbon-containing effluent from the hydrovisbreaking reactor is first treated in at least one additional hydrotreating process, more preferably carried out in a fixed bed reactor containing a suitable solid hydrofining catalysts (such as $Co/Mo/Al_2O_3$ or $Ni/Mo/Al_2O_3$) so as to reduce the amounts of remaining impurities (metals, S, N) in the liquid, and is then treated in a catalytic cracking process (e.g., a FCC process employing clay- or zeolite-containing catalysts) under such conditions so as to produce gasoline, distillate fuels and other useful products. It is, however, within the scope of this invention to catalytically crack (e.g., in the presence of zeolite or clay catalysts) at least a portion of said liquid product (effluent) from the hydrovisbreaking reactor without such an additional prior hydrotreating process employing solid hydrofining catalysts.

The following examples are presented in further illustration of the invention.

EXAMPLE I

In this example the experimental setup for batch-type hydrovisbreaking of heavy oils is described. About 100 grams of a topped (650° F.+) Hondo heavy crude (containing 12.1 weight-% Ramsbottom carbon residue, 5.6 weight-% S, 480 ppmw (V+Ni), a 1000° F.+ fraction of 62.0 weight-%; $API_{60}$ gravity; 9.0) and, when desired, appropriate amounts of various molybdenum containing catalyst compositions were added to a 300 cc, stirred autoclave (Autoclave Engineers, Inc., Erie, PA), which was preheated to about 200° F. The unit was sealed, alternately pressured with $H_2$ and vented so as to eliminate air, and finally pressued with $H_2$ to the desired starting pressure (about 1400 psig). Stirring at about 1000 r.p.m. and rapid heating up to the test temperature about 800° F. was carried out. During the test run, hydrogen gas was added so as to maintain a constant pressure of about 2000 psig at the final test temperature.

After heating at about 800° F. for about 60 minutes, the unit was cooled as quickly as possible, depressured and opened. The liquid product was collected and analyzed. Primarily, the amount of dispersed coke particles (collected by filtration through a 0.45 μm membrane filter and weighing) and the amount of the fraction boiling above 1000° F. at atmospheric conditions was determined.

EXAMPLE II

This example illustrates the results of hydrovisbreaking tests in accordance with the procedure outlined in Example I employing several thermally decomposable organic molybdenum compounds. Test results are summarized in Table I.

TABLE I

| | Run 1 (Control) | Run 2 (Control) | Run 3 (Control) | Run 4 (Control) | Run 5 (Invention) | Run 6 (Invention) |
|---|---|---|---|---|---|---|
| Catalyst | None | Mo Alkyl-phosphate[1] | Mo Oxysulfide Dithiocarbamate[2] | Mo Oxysulfide Dithiophosphate[3] | Mo Sulfonate[4] | Alkyl Molybdate[5] |
| ppm Mo Added to Feed | 100 | 100 | 100 | 100 | 100 | 100 |
| Coke Formation (Wt. % of Feed) | 10.7 | 4.1 | 3.1 | 1.8 | 1.9 | 1.7 |
| 1000° F.+ Conversion (Wt. %) | 71.2 | 75.8 | 75.6 | 69.0 | 67.6 | 69.7 |

[1]Provided by R. T. Vanderbilt Company, Norwalk, CT under the product designation of OD-842; containing 6.7 weight % Mo.
[2]Provided by R. T. Vanderbilt Company, Norwalk, CT under the product designation of Molyvan A.
[3]Provided by R. T. Vanderbilt Company, Norwalk, CT under the product designation of Molyvan L.
[4]Provided by R. T. Vanderbilt Company, Norwalk, CT under the product designation of OD-852; containing 11.5 weight % Mo, 53.6 weight % C, 7.9 weight % H, 3.8 weight % N and 6.5 weight % S. This material is a molybdenum salt of alkylated aromatic sulfonic acid.
[5]Provided by R. T. Vanderbilt Company, Norwalk, CT under the product designation of OD-844, containing 4.7 weight % Mo, 71.3 weight % C, 11.7 weight % H, 1.3 weight % N and 0 weight % S. This material is a substituted molybdenum glycol complex which has been prepared by reaction of $MoO_3$ with glycerol monooleate, substantially in accordance with the procedure disclosed in U.S. Pat. No. 3,285,942, whereby the two free OH groups of the glycerol monooleate reacted with $MoO_3$ to the glycerol monooleate (monoester of oleic acid and glycerol) reanged from about 1 to 2.

Test results in Table I show that the two hydrovisbreaking catalysts of this invention, alkyl molybdate and molybdenum sulfonate, were considerably more effective in reducing coke formation than molybdenum alkylphosphate and molbydenum oxysulfide dithiocarbamate (compares Runs 5 and 6 with Runs 2 and 3). The more preferred hydrovisbreaking catalyst of this invention, alkyl molybdate, was also more effective in reducing coke formation and in increasing heavies conversion than molybdenum oxysulfide dithiophosphate (compare Run 6 with Run 4).

Test data in Table I of U.S. Pat. No. 4,608,152 show that molybdenum diothiocarbamate is more effective in reducing coke formation than two molybdenum carboxylates (molybdenum naphthenate, molybdenum octoate) and phosphomolybdic acid. Since the hydrovisbreaking agents of this invention, alkyl molybdate and molybdenum sulfonate, are both more effective in reducing coke formation than Mo dithiocarbamate, it is concluded that alkyl molybdate and molybdenum sulfonate are also more effective hydrovisbreaking agents than molybdenum carboxylates and phosphomolybdic acids and salts thereof.

Reasonable variations and modification are possible within the scope of the disclosure and the appended claims to the invention.

We claim:

1. A hydrotreating process comprising the step of contacting (A) a substantially liquid hydrocarbon-containing feed stream, which also contains Ramsbottom carbon residue, as determined by ASTM D524, in excess of about 0.1 weight-%, simultaneously with (B) a free hydrogen-containing gas, and (C) a catalyst composition comprising a mixture of at least one alkyl molybdate and at least one molybdenum sulfonate, under such hydrotreating conditions as to obtain a liquid product having reduced amounts of Ramsbottom carbon residue and reduced amounts of hydrocarbons boiling in excess of 1000° F. at atmospheric pressure.

2. A process in accordance with claim 1, wherein said substantially liquid hydrocarbon-containing feed stream contains more than about 1 weight-% Ramsbottom carbon residue.

3. A process in accordance with claim 1, wherein said substantially liquid hydrocarbon-containing containing feed stream contains about 2 to about 30 weight-% Ramsbottom carbon residue.

4. A process in accordance with claim 1, wherein said substantially liquid hydrocarbon-containing feed stream further contains about 3–500 ppmw nickel, about 5–1000 ppmw vanadium, about 0.2–6 weight-% sulfur and about 1–99 weight-% of materials boiling in excess of about 1000° F. under atmospheric pressure conditions.

5. A process in accordance with claim 1, wherein said substantially liquid hydrocarbon-containing feed stream is selected from the group consisting of heavy crude oils, crude oil residua, heavy fractions of liquid coal pyrolyzates, heavy fractions of liquid products obtained by extraction of coal, heavy fractions of liquid products obtained by liquefaction of coal, heavy fractions of liquids obtained by extraction of tar sands, heavy fractions of liquids obtained by pyrolysis of tar sands, heavy shale oils and heavy shale oil fractions.

6. A process in accordance with claim 1, wherein said free hydrogen-containing gas is substantially pure hydrogen.

7. A process in accordance with claim 1, wherein said at least one alkyl molybdate comprises at least one substituted glycol molybdate complex.

8. A process in accordance with claim 7, wherein said at least one substituted glycol molybdate complex is an ester-substituted glycol molybdate complex.

9. A process in accordance with claim 8, wherein said ester-substituted glycol molybdate complex has been prepared by reaction of $MoO_3$ and a glycerol monocarboxylate, wherein the carboxylate group can have 1–40 carbon atoms.

10. A process in accordance with claim 9, wherein said glycerol monocarboxylate is glycerol monooleate.

11. A process in accordance with claim 8, wherein said catalyst composition contains about 4–6 weight-% Mo, about 70–73 weight-% C, about 11–13 weight-% H and about 1–1.5 weight-% N.

12. A process in accordance with claim 1, wherein said at least one molybdenum sulfonate is a Mo compound of an aromatic sulfonic acid.

13. A process in accordance with claim 1, wherein said catalyst composition contains about 10–13 weight-% Mo, about 52–55 weight-% C, about 7–9 weight-% H, about 3–4 weight-% N and about 6–7 weight-% S.

14. A process in accordance with claim 1, wherein said hydrotreating conditions comprise a hydrogen addition in the range of from about 100 to about 20,000 standard cubic feet of $H_2$ per barrel of hydrocarbon-containing feed, a time of contact between (A), (B) and (C) in the range of from about 0.01 to about 20 hours, a reaction temperature in the range of from about 250° to about 550° C. and a reaction pressure in the range of from about 0 psig to about 10,000psig.

15. A process in accordance with claim 1, wherein said hydrotreating conditions comprise a hydrogen addition in the range of from about 500 to about 5,000 standard cubic feet of $H_2$ per barrel of hydrocarbon-containing feed, a time of contact between (A), (B) and (C) in the range of from about 0.1 to about 5 hours, a reaction temperature in the range of from about 380° to about 480° F. and a reaction pressure in the range of from about 500 psig to about 3,000 psig.

16. A process in accordance with claim 1, wherein the amount of catalyst composition (C) is such that the molybdenum concentration during said contacting is about 1–2,000 ppmw Mo in said hydrocarbon-containing feed stream.

17. A process in accordance with claim 1, wherein the amount of catalyst composition (C) is such that the molybdenum concentration during said contacting is about 5–500 ppmw Mo in said hydrocarbon-containing feed stream.

18. A process in accordance with claim 1 comprising the additional step of withdrawing gaseous, liquid and solid products from a reactor in which said contacting is carried out.

19. A hydrotreating process comprising the step of contacting (A) a substantially liquid hydrocarbon-containing feed stream, which also contains Ramsbottom carbon residue, as determined by ASTM D524, in excess of about 0.1 weight-%, simultaneously with (B) a free hydrogen-containing gas, and (C) a catalyst composition comprising at least one alkyl molybdate, under such hydrotreating conditions as to obtain a liquid product having reduced amounts of Ramsbottom carbon residue and reduced amounts of hydrocarbons boiling in excess of 1000° F. at atmospheric pressure.

20. A process in accordance with claim 19, wherein said substantially liquid hydrocarbon-containing feed stream contains more than about 1 weight-% Ramsbottom carbon residue.

21. A process in accordance with claim 19, wherein said substantially liquid hydrocarbon-containing feedstream contains about 2 to about 30 weight-% Ramsbottom carbon residue.

22. A process in accordance with claim 19, wherein said substantially liquid hydrocarbon-containing feedstream further contains about 3–500 ppmw nickel, about 5–1000 ppmw vanadium, about 0.2–6 weight-% sulfur and about 1–99 weight-% of materials boiling in excess of about 1000° F. under atmospheric pressure conditions.

23. A process in accordance with claim 19, wherein said substantially liquid hydrocarbon-containing feedstream is selected from the group consisting of heavy crude oils, crude oil residua, heavy fractions of liquid coal pyrolyzates, heavy fractions of liquid products obtained by extraction of coal, heavy fractions of liquid products obtained by liquefaction of coal, heavy fractions of liquids obtained by extraction of tar sands, heavy fractions of liquids obtained by pyrolysis of tar sands, heavy shale oils and heavy shale oil fractions.

24. A process in accordance with claim 19, wherein said free hydrogen-containing gas is substantially pure hydrogen.

25. A process in accordance with claim 19, wherein said at least one alkyl molybdate is a substituted glycol molybdate complex.

26. A process in accordance with claim 25, wherein said at least one substituted glycol molybdate complex is an ester-substituted glycol molybdate complex.

27. A process in accordance with claim 26, wherein said ester-substituted glycol molybdate complex has been prepared by reaction of $MoO_3$ and a glycerol monocarboxylate, wherein the carboxylate group can have 1–40 carbon atoms.

28. A process in accordance with claim 27, wherein said glycerol monocarboxylate is glycerol monooleate.

29. A process in accordance with claim 26, wherein said catalyst composition contains about 4–6 weight-% Mo, about 70–73 weight-% C, about 11–13 weight-% H and about 1–1.5 weight-% N.

30. A process in accordance with claim 19, wherein said hydrotreating conditions comprise a hydrogen addition in the range of from about 100 to about 20,000 standard cubic feet of $H_2$ per barrel of hydrocarbon-containing feed, a time of contact between (A), (B) and (C) in the range of from about 0.01 to about 20 hours, a reaction temperature in the range of from about 250° to about 550° C. and a reaction pressure in the range of from about 0 psig to about 10,000psig.

31. A process in accordance with claim 19, wherein said hydrotreating conditions comprise a hydrogen addition in the range of from about 500 to about 5,000 standard cubic feet of $H_2$ per barrel of hydrocarbon-containing feed, a time of contact between (A), (B) and (C) in the range of from about 0.1 to about 5 hours, a reaction temperature in the range of from about 380° to about 480° F. and a reaction pressure in the range of from about 500 psig to about 3,000 psig.

32. A process in accordance with claim 19, wherein the amount of catalyst composition (C) is such that the molybdenum concentration during said contacting is about 1–2,000 ppmw Mo in said hydrocarbon-containing feed stream.

33. A process in accordance with claim 19, wherein the amount of catalyst composition (C) is such that the molybdenum concentration during said contacting is about 5–500 ppmw Mo in said hydrocarbon-containing feed stream.

34. A process in accordance with claim 19, comprising the additional step of withdrawing gaseous, liquid and solid products from a reactor in which said contacting is carried out.

* * * * *